US009388032B2

(12) United States Patent
Singur

(10) Patent No.: US 9,388,032 B2
(45) Date of Patent: Jul. 12, 2016

(54) MAGNETIC CAP EJECTOR IN A CAPPER

(75) Inventor: Igor Singur, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 901 days.

(21) Appl. No.: 13/582,791

(22) PCT Filed: Mar. 24, 2011

(86) PCT No.: PCT/EP2011/001464

§ 371 (c)(1),
(2), (4) Date: Sep. 5, 2012

(87) PCT Pub. No.: WO2011/150991

PCT Pub. Date: Dec. 8, 2011

(65) Prior Publication Data

US 2013/0000251 A1 Jan. 3, 2013

(30) Foreign Application Priority Data

May 31, 2010 (DE) ..... 10 2010 022 291

(51) Int. Cl.

| | |
|---|---|
| ***B65B 7/28*** | (2006.01) |
| ***B67B 3/26*** | (2006.01) |
| ***B67B 3/20*** | (2006.01) |

(52) U.S. Cl.

CPC ..... *B67B 3/268* (2013.01); *B67B 3/2066* (2013.01)

(58) Field of Classification Search

CPC ..... B67B 3/2066; B67B 3/268; B67B 3/206; B67B 3/2053; B67B 3/20; B67B 2201/065; B65B 7/2835

USPC ..... 53/287, 331.5, 307, 535, 356, 367, 317

See application file for complete search history.

(56) References Cited

U.S. PATENT DOCUMENTS

| | | | | |
|---|---|---|---|---|
| 5,284,001 | A | 2/1994 | Ochs | |
| 6,508,046 | B1 | 1/2003 | Resterhouse et al. | |
| 2010/0037557 | A1* | 2/2010 | Wilhelm et al. | 53/331.5 |
| 2010/0069943 | A1* | 3/2010 | Roe | 606/181 |
| 2010/0307110 | A1* | 12/2010 | Wilhelm et al. | 53/329.2 |
| 2011/0162331 | A1* | 7/2011 | Singur | 53/485 |
| 2011/0167761 | A1* | 7/2011 | Jha et al. | 53/317 |

FOREIGN PATENT DOCUMENTS

| | | |
|---|---|---|
| DE | 100 56 990 A1 | 5/2002 |
| DE | 202 18 523 | 3/2003 |
| DE | 102 55 196 A1 | 7/2004 |
| GB | 708 994 | 5/1954 |

* cited by examiner

*Primary Examiner* — Gloria R Weeks
*Assistant Examiner* — Chinyere Rushing-Tucker
(74) *Attorney, Agent, or Firm* — Occhiuti & Rohlicek LLP

(57) ABSTRACT

An apparatus for sealing containers with one of a sealing cap and a screw cap includes an ejector having a function element that returns an ejecting element from an ejection position to an initial position. The function element is formed as a magnetic element.

5 Claims, 4 Drawing Sheets

MAGNETIC CAP EJECTOR IN A CAPPER

CROSS REFERENCE TO RELATED APPLICATION

This application is the national phase filing of international application no. PCT/EP2011/001464, filed Mar. 24, 2011, which claims priority to German application no. 10 2010 022 291.7, filed May 31, 2010. The contents of the aforementioned applications are incorporated herein in their entirety.

FIELD OF DISCLOSURE

The invention relates to a device for sealing containers with sealing caps or screw caps, comprising an ejector which has a functional element which returns an ejecting element from an ejection position to an initial position.

BACKGROUND

DE 202 18 523 U1 for example discloses a device for sealing containers, namely bottles with sealing or screw caps e.g. with internal thread, so that the screw caps can be screwed onto the bottle. To seal these, the upright bottles are transferred in succession by a transporter via an inlet star forming a bottle inlet of the device to one of the sealing positions. The sealed containers or bottles are taken via an outlet star from the sealing positions and discharged via a transporter. Each container or each bottle and hence each bottle holder executes a controlled vertical lift movement when the rotor is rotating, so that a screw cap is collected from each screw head at a delivery position, then the mouth of the bottle is moved against the screw cap which is screwed on by rotation of a spindle about its spindle axis and tightened with the specified torque. DE 202 18 523 U1 discloses that the delivery position is provided between the outlet star and the inlet star in the circulation direction of the rotor. The screw or sealing caps are supplied to the delivery position via a feed from a magazine in the necessary orientation and preferably tightly together in single file. In practice it has been shown that not all screw or sealing caps collected are used or some remain suspended, so that an ejector arranged on a height-adjustable carrier rod is provided for the unused or suspended screw or sealing caps. The ejector itself is mounted height-adjustably on a screw shaft and can be moved downwards against the force of a function element designed as a spring in DE 202 18 523 U1 by an ejector rod, which is suitably also height-adjustable together with the bottle holder, in order to remove the screw cap, so that an ejector finger acts against the screw or sealing cap and removes it. When the unused screw or sealing cap is removed, the ejector finger is returned against the force of the function element i.e. under spring force from the ejection position to the starting position.

DE 102 55 196 A1 also discloses a device for closing vessels which also has an ejector with a function element designed as a spring.

DE 10 2006 035 279 A1 and DE 100 56 990 A1 both describe a capping machine, wherein the problem of unused or suspended sealing or screw caps is not discussed.

In principle the capping machines disclosed in the cited prior art have proved suitable in practice. However the design of the ejector with its mechanical function element is worthy of improvement. For example the function element designed as a spring is subject to substantial wear so that as the operating period extends, spring damage can occur. Changing the function element or spring is however extremely complicated and time-consuming not merely because of the restricted construction space but because of the complex structure of the entire system which, with its individual components, must be designed and installed adapted to other components. It is also disadvantageous that dirt can collect in particular in cavities or niches in the spring region. In particular with plant in the drinks industry, bacteria can then develop which can substantially damage the quality of the product filled in the bottles or containers or even make this completely unusable or undrinkable, so that substantial rejection rates can occur.

SUMMARY

The invention is therefore based on the object of improving a device for sealing containers with sealing or screw caps, in particular their ejectors, with simple means so that the ejecting element can be returned from its ejection position to its initial position while avoiding said disadvantages.

According to the invention the object is achieved by a device for sealing containers with sealing or screw caps wherein the function element is designed as a magnetic element.

In the sense of the invention it is suitable if the function element has a permanent magnet which is arranged in a housing mobile relative thereto, wherein at least one wall segment of the housing arranged in an axial direction is magnetisable. To this extent it is advantageously provided that the function element is formed from the permanent magnet in cooperation with the magnetisable wall segment of the housing. It is essential that the magnetic forces act to return the ejecting element to its starting position while avoiding a magnetically active function element.

Favourably the permanent magnet is designed as a diametrically magnetised bar magnet i.e. viewed in cross section a round bar magnet, the magnetisation of which runs through the diameter wherein the north and south poles lie against each other as half shells.

It is favourable if the function element or its permanent magnet is arranged in a sleeve which at both ends, i.e. at the top and its opposing foot side, comprises a sealing element for example in the manner of a cap. The sealing element can be joined to the sleeve by material connection. A glue connection or weld connection is conceivable here. The sleeve and the caps can be made of a plastic and completely enclose the permanent magnet so that the permanent magnet is enclosed and hermetically sealed all round from the environment.

The permanent magnet can thus be introduced with its head end or head cap into the housing.

In a preferred embodiment it is proposed that the housing is open at the foot. In its foot region the housing favourably has a threaded segment for connection with a sealing head. The threaded segment is followed by the magnetisable wall segment of the housing which transforms into a head part. The housing has a continuous bore which has a conductor segment, a guide segment and an actuating segment. The conductor segment extends from the foot opening towards the head part and transforms into the guide segment which has a reduced internal diameter in relation to the conductor segment. The guide segment is followed by the actuating segment which first transforms with a tapering transitional region into a cylindrical region. In the cylindrical region engages a tappet which is in connection with a force transfer element that is guided in a link connector guide on the head side of the housing. E.g. an ejector control rod acts in the known manner on the force transfer element. It is suitable if the tappet with its outer diameter is adapted to the cylindrical region of the continuous bore arranged on the head side, wherein the outer diameter can be dimensioned slightly smaller than the internal diameter of the cylindrical region.

The permanent magnet is thus held in the housing so that in its starting position this protrudes from the housing on the foot side and engages slightly in the guide segment on the head side. Viewed in the peripheral direction, the permanent magnet surrounded by the sleeve is designed with a smaller outer diameter than the respective internal diameter of both the conductor segment and the guide segment.

The ejecting element is connected with the foot cap of the permanent magnet in which is favourably arranged a receiver bore to receive a corresponding receiver segment of the ejecting element.

If now the force transfer element moves via the ejector control rod along the housing in the direction of the foot side, the tappet causes a longitudinal movement of the permanent magnet held in the sleeve relative to the housing, preferably relative to its guide segment, and at the same time relative to the magnetisable wall segment of the housing, and is moved out of the housing in regions. The permanent magnet with its head end is moved out of the guide segment. An axial displacement path i.e. the transfer from the initial position in the direction towards or up to the ejection position of the ejecting element is preferably adapted to the height of a screw cap or sealing cap.

The magnetisable wall segment favourably extends from the head part in the direction towards the threaded segment or up to the threaded segment, and comprises the guide segment and a part region of the conductor segment of the continuous bore.

When the ejecting element has removed the unused or suspended screw or sealing cap, the ejecting element is returned to the starting position by means of the magnetic force activated by the magnetic element (permanent magnet/magnetisable wall segment).

It is suitably provided that the magnetisable wall segment is formed by a magnet, preferably a magnetisable material, further preferably a magnetisable special steel e.g. with material number 1.4112.

BRIEF DESCRIPTION OF THE FIGURES

Further advantageous embodiments of the invention are disclosed in the subclaims and the description of the figures which follows. These show:

In the different figures the same parts always have the same reference numerals so these are usually only described only.

DETAILED DESCRIPTION

Figure 1:
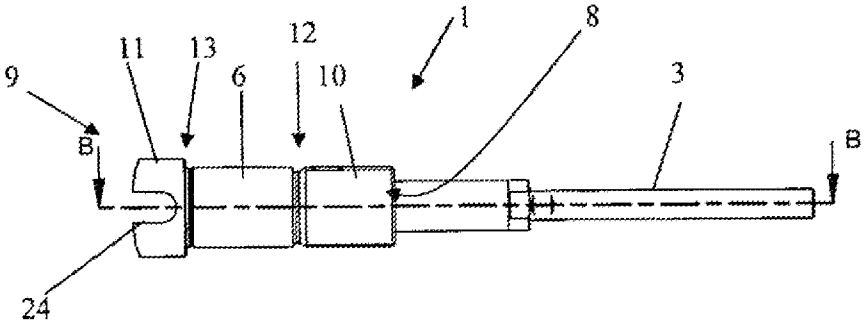
FIG. 1 an ejector in side view.

FIG. 1 shows an ejector 1 of a device not shown for sealing containers with sealing or screw caps. Such devices are known e.g. from DE 202 18 523 U1, wherein here no further details are given of this or the supply of sealing or screw caps. By means of the ejector 1 any unused or suspended screw or sealing caps can be removed from the sealing head also not shown.

The ejector 1 has a function element 2 which guides an ejecting element 3 out of an ejection position 4 into an initial position not shown. The function element 2 is advantageously designed as a magnetic (function) element 2 and has a permanent magnet 5 and a magnetisable wall segment 6 of a housing 7.

The housing 7 has a foot side 8 and opposite this a head side 9. A threaded segment 10 extends from the foot side 8 in the direction towards the head side 9. The magnetisable wall segment 6 abuts the threaded segment 10 and is itself abutted by a head part 11.

Between the threaded segment 10 and the magnetisable wall segment 6 is arranged for example a groove 12. The two segments 10 and 6 have for example approximately the same axial extent or length. Between the magnetisable wall segment 6 and the head part 11 is arranged for example a step 13.

In the housing 7 is arranged a continuous bore 14 open on the foot side, which extends into the head part 11 from the foot side 8.

Figure 1A:
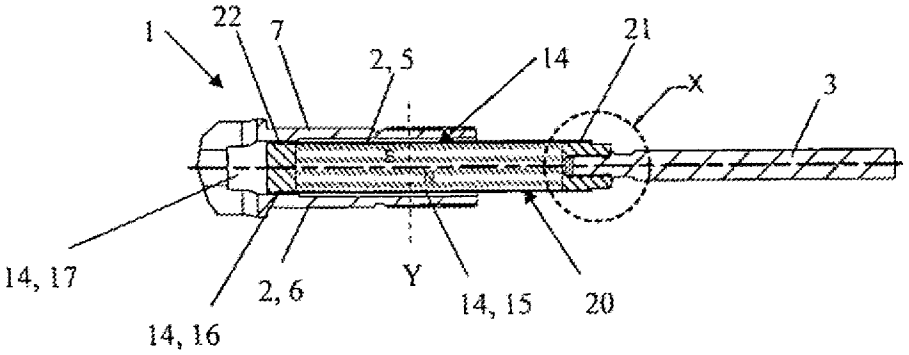
FIG. 1*a* the ejector from FIG. 1 in longitudinal section.

The continuous bore 14 is designed stepped with a conductor segment 15, a guide segment 16 and an actuating segment 17 as shown in FIG. 1*a*.

Figure 2:
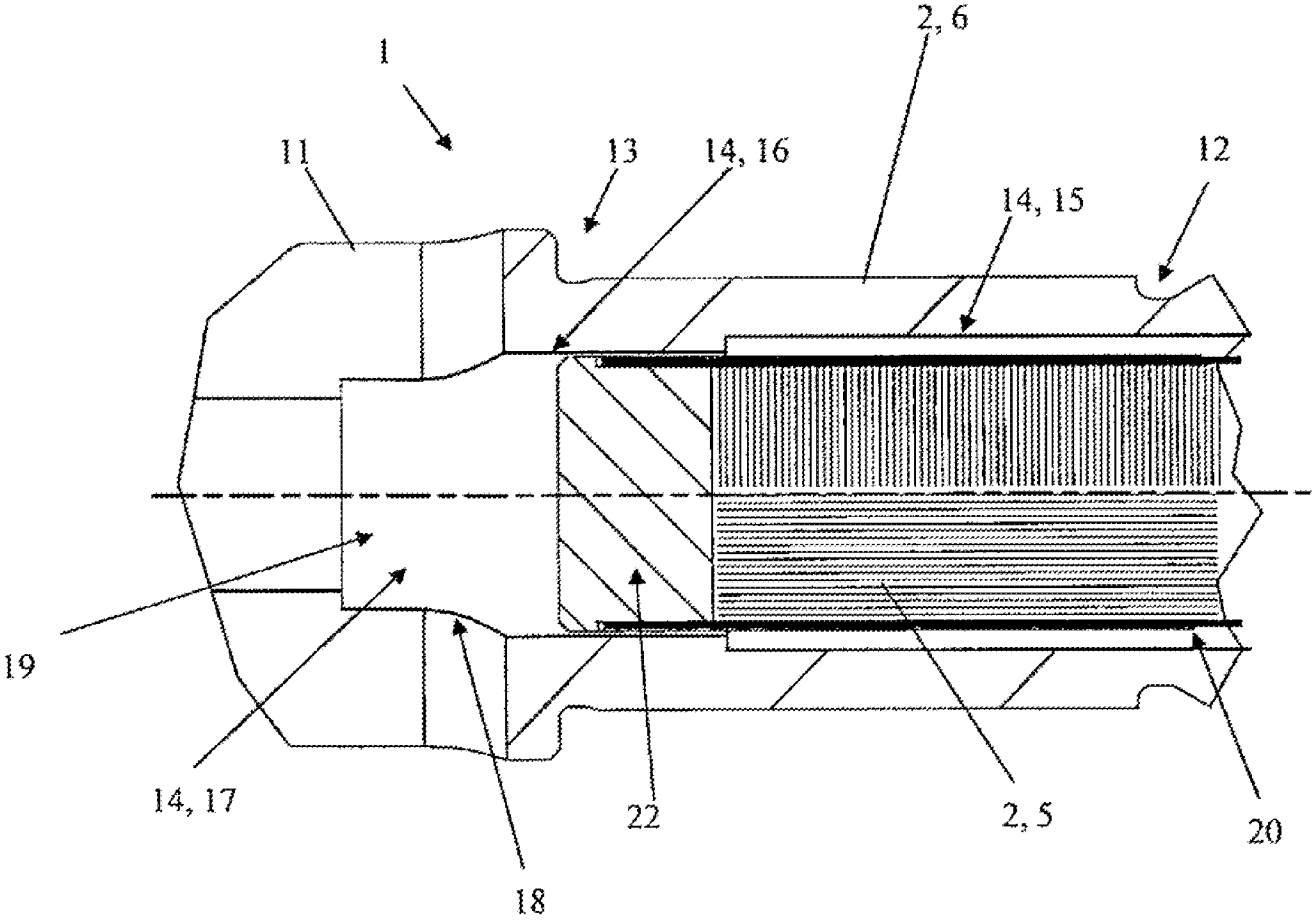
FIG. 2 an enlarged extract of the head side of the ejector in FIG. 1.
Figure 3:
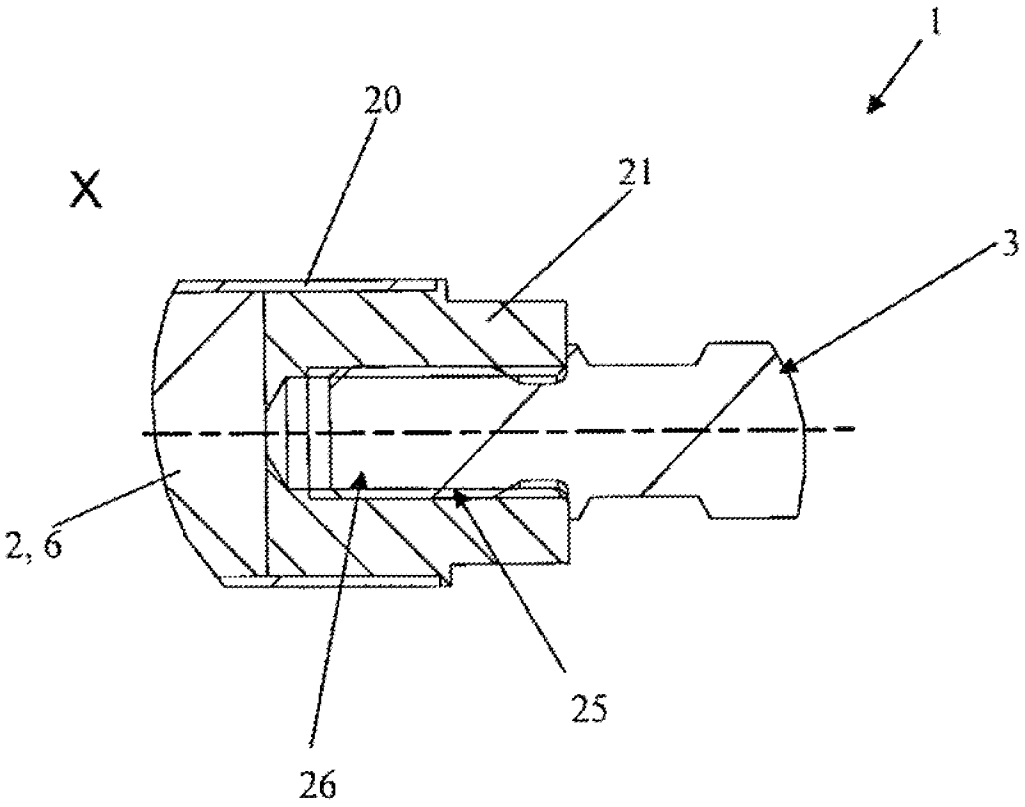
FIG. 3 an enlarged extract of the X region from FIG. 1*a*.

The conductor segment 15 extends from the foot side 8 through the threaded segment 10 into the magnetisable wall segment 6 and ends—viewed in the longitudinal direction—slightly before the head part 11. The conductor segment 15 is followed by the guide segment 16 which has a reduced internal diameter in relation to the conductor segment 15, so that a step is formed at the transition from the conductor segment 15 to the guide segment 16 (FIG. 2).

The guide segment 16 has a shorter axial length than the conductor segment 15, which naturally can merely be an example. The guide segment 16 for example extends only through the magnetisable wall segment 6 and ends at the transition to the head part 11 (FIG. 2).

The actuating segment 17 extends through the head part 11 and has two segments 18 and 19. A transition segment 18 follows the guide segment 16 and is designed tapering conically. The transition region 18 is followed by a cylindrical region 19.

Figure 4:
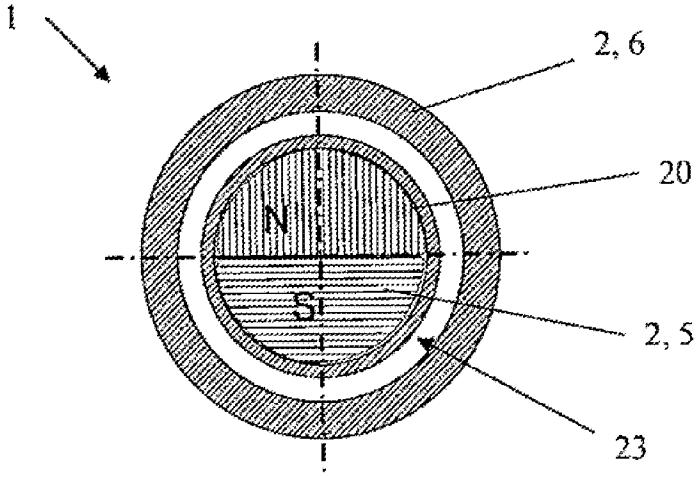
FIG. 4 a cross section through the ejector along line Y of FIG. 1*a*.

The permanent magnet 5 is designed for example as a diametrically magnetised bar magnet. The two poles are marked N and S in FIGS. 1*a* and 4. The permanent magnet 5 is surrounded by a sleeve 20 on which are arranged, both on the head side and the foot side, sealing elements 21 and 22, in this example embodiment as a foot cap 21 and head cap 22.

Sleeve 20 and caps 21 and 22 can be made of a plastic and are connected together. For example a material connection can be selected in the manner of a glue or weld connection. The plastic sheathing of permanent magnet 5 can e.g. have a corrosion protection effect.

As can be seen in FIGS. 1 and 1*a*, the permanent magnet 5 with the surrounding sleeve 20 is held in the housing 7 and mobile relative thereto.

Permanent magnet 5 together with the surrounding sleeve 20 has an outer diameter which is smaller than the internal diameter of both the conductor segment 15 and the guide segment 16. As an example in FIG. 4 a ring gap 23 is shown between the outer periphery of the sleeve 20 with permanent magnet 5 arranged therein and the magnetisable wall segment 6 along line Y i.e. in the region of conductor segment 15.

A tappet not shown in connected with the head side cap 22. The tappet is connected with a force transfer element not shown on which acts an ejector control rod not shown. The tappet extends through the actuating segment 17 in the direction of the head cap 22. To this extent the head cap 22 can be regarded as a buffer element which prevents a direct contact of tappet and permanent magnet 5. The head cap 22 can also be regarded as a guide element within the guide segment 16.

Arranged in the head part 11 is an axial guide slot 24 which guides the force transfer element in the longitudinal direction of housing 7. Because of the view selected, only a lower segment of the guide slot 24 can be seen, wherein an upper segment is not shown. Opposite the guide slot 24 shown in the drawing plane, or opposite the guide link connector 24 shown, is a further guide slot which is also closed all round. The force transfer element and tappet arranged therein are thus force guided on the housing 7 on diametrically opposed guide link connectors.

Arranged on the permanent magnet 5 is the ejecting element 3 which can be designated an ejector finger. The ejecting element 3 is for example held positionally secure in a receiver bore 25 arranged in the foot cap 21 with a receiver region 26 adapted thereto. It is conceivable to arrange a thread on the receiver region 26 to create a screw connection, wherein a contact flange can be arranged on the receiver region which can lie on a face side of cap 21. The ejecting element 3 acts on the unused or suspended seal or screw cap so that this is ejected i.e. removed from the sealing head.

The permanent magnet 5 is held in the housing 7 and can be moved or displaced relative thereto.

The housing 7 with its threaded segment 10 is connected with the sealing head through which the ejecting element 3 or ejector finger travels coaxially. If now the force transfer element is activated via the ejector control rod, the tappet acts on the head cap 22 such that the permanent magnet 5 is moved along its longitudinal axis in the direction towards the foot side 8 relative to the magnetisable wall 6 of housing 7, whereby also the ejecting element 3 connected with the permanent magnet 5 is moved into the ejection position 4 shown in the figures.

Because of the magnetic force generated by the magnetic element 2 i.e. by cooperation of the permanent magnet 5 with the magnetisable wall 6, the permanent magnet 5 and hence the ejecting element 3 are returned to an initial position not shown.

It is clear that with the invention, mechanical function elements such as for example springs, which are subject to great wear and susceptible to fault, can be omitted. Also no spring niches are formed in which dirt can collect. It is possible that sealing elements are arranged on the foot side of the housing 7 which seal the ring gap 23.

LIST OF REFERENCE NUMERALS

1 Ejector
2 Magnetic (function) element
3 Ejecting element
4 Ejection position
5 Permanent magnet
6 Magnetisable wall segment
7 Housing
8 Foot side
9 Head side
10 Threaded segment
11 Head part
12 Groove
13 Step
14 Continuous bore
15 Conductor segment
16 Guide segment
17 Actuating segment
18 Transitional region
19 Cylindrical region
20 Sleeve
21 Foot cap
22 Head cap
23 Ring gap
24 Guide slot
25 Receiver bore
26 Receiver region

The invention claimed is:

1. An apparatus for sealing containers with one of a sealing cap and a screw cap, said apparatus comprising an ejector comprising a function element that returns an ejecting element from an ejection position to an initial position, said function element being formed as a magnetic element, said function element comprising a housing, a wall forming a bore, a magnetizable wall segment, and a permanent magnet, wherein said housing comprises said wall forming said bore, wherein said housing houses said function element and said permanent magnet, wherein said bore comprises said magnetizable wall segment, wherein said magnetizable wall segment surrounds said permanent magnet, and wherein said permanent magnet is movable relative to said housing; wherein said permanent magnet comprises a diametrically magnetized bar magnet.

2. The apparatus of claim 1, wherein said permanent magnet is held in a sleeve comprising sealing elements.

3. The apparatus of claim 1, wherein said housing is open on a foot side and comprises a continuous bore.

4. The apparatus of claim 1 wherein said housing comprises a head part and a foot region, wherein said foot region comprises a threaded segment followed by a magnetizable wall segment on which is arranged said head part.

5. The apparatus of claim 4, wherein said threaded segment comprises a magnetizable material.

* * * * *